US012808111B2

(12) United States Patent
Kulkarni et al.

(10) Patent No.: US 12,808,111 B2
(45) **Date of Patent: *Nov. 24, 2026**

(54) INNER-FACING PANEL FOR AN OPERABLE DOOR OF AN APPLIANCE

(71) Applicant: WHIRLPOOL CORPORATION, Benton Harbor, MI (US)

(72) Inventors: Sripad Kulkarni, St. Joseph, MI (US); Chaitanya Salve, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/368,071

(22) Filed: Oct. 24, 2025

(65) Prior Publication Data

US 2026/0049429 A1 Feb. 19, 2026

Related U.S. Application Data

(62) Division of application No. 18/071,102, filed on Nov. 29, 2022, now Pat. No. 12,486,607.

(51) Int. Cl.
*D06F 37/28* (2006.01)

(52) U.S. Cl.
CPC ..... *D06F 37/28* (2013.01)

(58) Field of Classification Search
CPC ..... D06F 37/28
USPC ..... 68/196
See application file for complete search history.

(56) References Cited

U.S. PATENT DOCUMENTS

| | | | |
|---|---|---|---|
| 6,670,587 | B1 | 12/2003 | DiSalvo |
| 7,164,102 | B2 | 1/2007 | DiSalvo |
| 9,708,749 | B2 | 7/2017 | Woo et al. |
| 9,752,271 | B2 | 9/2017 | Bazzinotti |
| 10,060,066 | B2 | 8/2018 | Anand et al. |
| 10,253,441 | B2 | 4/2019 | Anand et al. |
| 10,745,852 | B2 | 8/2020 | Nam et al. |
| 2012/0187811 | A1 | 7/2012 | Kim et al. |
| 2020/0113408 | A1 | 4/2020 | Ford, Jr. |

FOREIGN PATENT DOCUMENTS

| | | | |
|---|---|---|---|
| CN | 101812795 | B | 8/2011 |
| CN | 109419474 | A | 3/2019 |
| DE | 8911169 | U1 | 10/1990 |
| WO | 2012027072 | A1 | 3/2012 |
| WO | 2015144236 | A1 | 10/2015 |

*Primary Examiner* — Tinsae B Ayalew
(74) *Attorney, Agent, or Firm* — Price Heneveld LLP

(57) ABSTRACT

A laundry appliance includes a cabinet having an access aperture positioned within a door-receiving recess to provide access to a processing space within the cabinet. A door is rotationally operable relative to the door-receiving recess to selectively enclose the processing space. The door has an inner-facing panel that defines a plurality of recesses. Hinges are fixedly attached to first and second recesses and to a planar surface of the door-receiving recess that surrounds the access aperture. A magnetic lock is fixedly attached to a third recess and is selectively and magnetically attached to the planar surface to define a closed position of the door panel. The plurality of recesses selectively and alternatively receive one of the hinges and the magnetic lock to define a swing direction of the door panel. The hinges are attached to and the magnetic lock selectively engages the planar surface.

20 Claims, 10 Drawing Sheets

INNER-FACING PANEL FOR AN OPERABLE DOOR OF AN APPLIANCE

CROSS-REFERENCE TO RELATED APPLICATION

The present application is a divisional of U.S. patent application Ser. No. 18/071,102 filed Nov. 29, 2022, now U.S. Pat. No. 12,486,607, entitled INNER-FACING PANEL FOR AN OPERABLE DOOR OF AN APPLIANCE, the entire disclosure of which is hereby incorporated herein by reference.

BACKGROUND OF THE DISCLOSURE

The present disclosure generally relates to appliances, and more specifically, to a door for an appliance that includes an inner-facing panel having a plurality of recesses that can selectively and alternatively receive hinges and a magnetic lock, where the recesses position the hinges and the magnetic lock to be in a flush configuration with an outer surface of the inner-facing panel.

SUMMARY OF THE DISCLOSURE

According to one aspect of the present disclosure, a laundry appliance includes an outer cabinet that has an access aperture positioned within a door-receiving recess of the cabinet. The access aperture provides access to a processing space within the cabinet. A door panel is rotationally operable relative to the door-receiving recess to selectively enclose the processing space in a closed position of the door panel. The door panel has an inner-facing panel that defines a plurality of recesses. Hinges are fixedly attached to first and second recesses, respectively, of the plurality of recesses, and to a planar surface of the cabinet within the door-receiving recess. The planar surface surrounds the access aperture. A magnetic lock is fixedly attached to a third recess of the plurality of recesses. The magnetic lock is selectively and magnetically attached to the planar surface to define the closed position. The plurality of recesses of the inner-facing panel are configured to selectively and alternatively receive one of the hinges and the magnetic lock to define a swing direction of the door panel. The hinges are attached directly to the planar surface and the magnetic lock selectively engages the planar surface in the closed position of the door panel.

According to another aspect of the present disclosure, a door panel for a laundry appliance includes an outer-facing panel. An inner-facing panel is attached to the outer-facing panel, and has a plurality of recesses. A pair of hinges are attached to first and second recesses of the plurality of recesses. Each hinge of the pair of hinges has a respective cabinet-attaching surface. A magnetic lock is attached to a third recess of the plurality of recesses. The magnetic lock has a cabinet-engaging surface. Each recess of the plurality of recesses includes a deep step that is configured to selectively and alternatively receive the magnetic lock and one hinge of the pair of hinges. The deep step is configured to receive one hinge of the pair of hinges and locate the respective cabinet-attaching surface to be flush with an outer surface of the inner-facing panel when the pair of hinges are in a closed position. A shallow step is configured to receive the magnetic lock and locate the cabinet-engaging surface to be flush with the outer surface of the inner-facing panel.

According to yet another aspect of the present disclosure, a door panel for a laundry appliance includes an inner-facing panel that is configured to selectively engage a continuous planar surface of a structural cabinet. The inner-facing panel has a plurality of recesses. Each recess of the plurality of recesses includes a shallow step and a deep step. First and second hinges are attached to respective first and second recesses of the plurality of recesses and within the deep step of the first and second recesses. The first and second hinges have a cabinet-attaching surface that is flush with an outer surface of the inner-facing panel. A magnetic lock is attached to a third recess of the plurality of recesses. The magnetic lock is attached to the shallow step and has a cabinet-engaging surface that is flush with the cabinet-attaching surface of each of the first and second hinges. Each recess of the plurality of recesses is configured to selectively and alternatively receive one of the magnetic lock, the first hinge, and the second hinge.

These and other features, advantages, and objects of the present disclosure will be further understood and appreciated by those skilled in the art by reference to the following specification, claims, and appended drawings.

Figure 1:
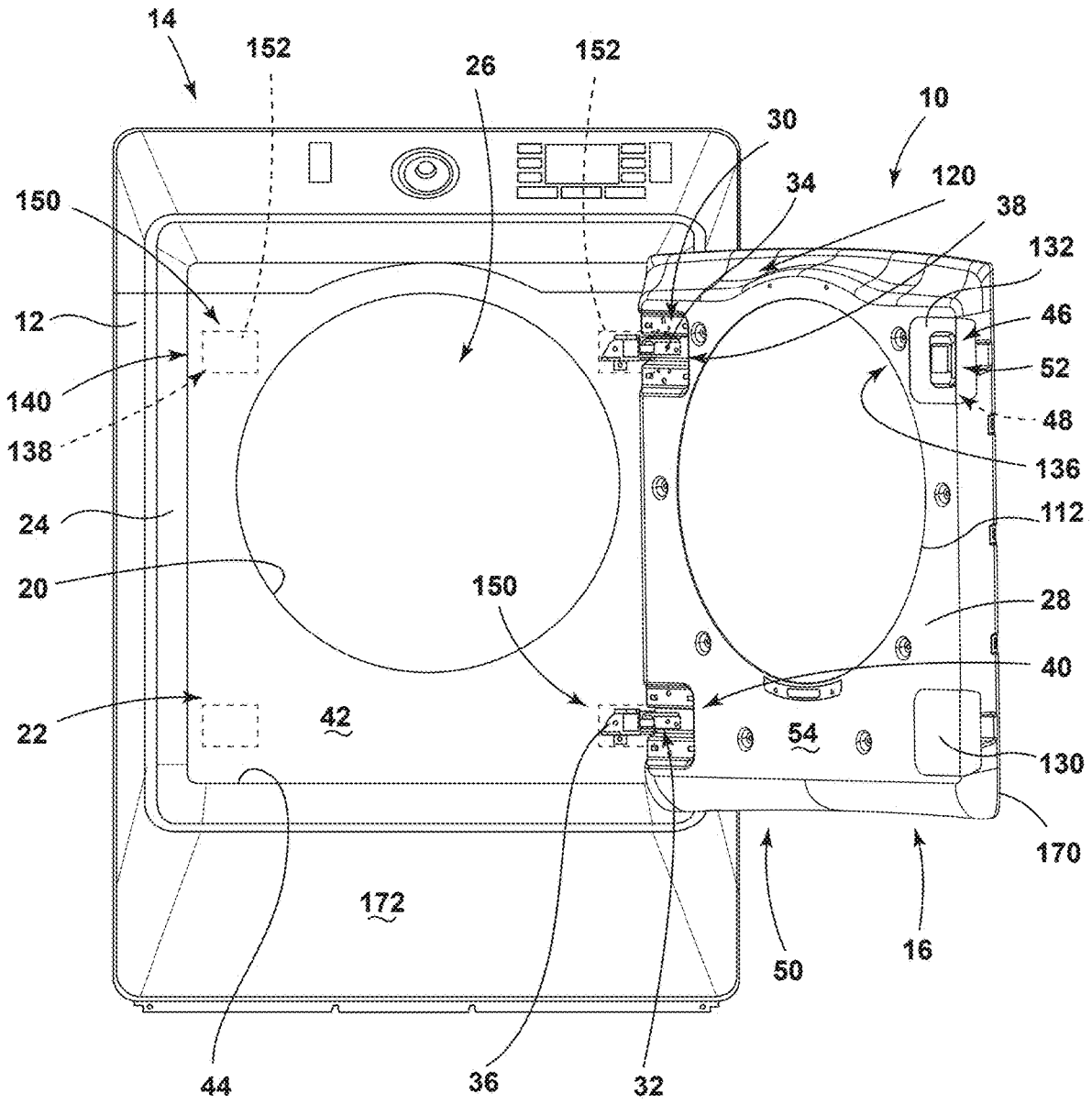
FIG. 1 is a front elevation view of a laundry appliance that incorporates an aspect of the inner-facing panel and showing the door panel in an open position.
Figure 2:
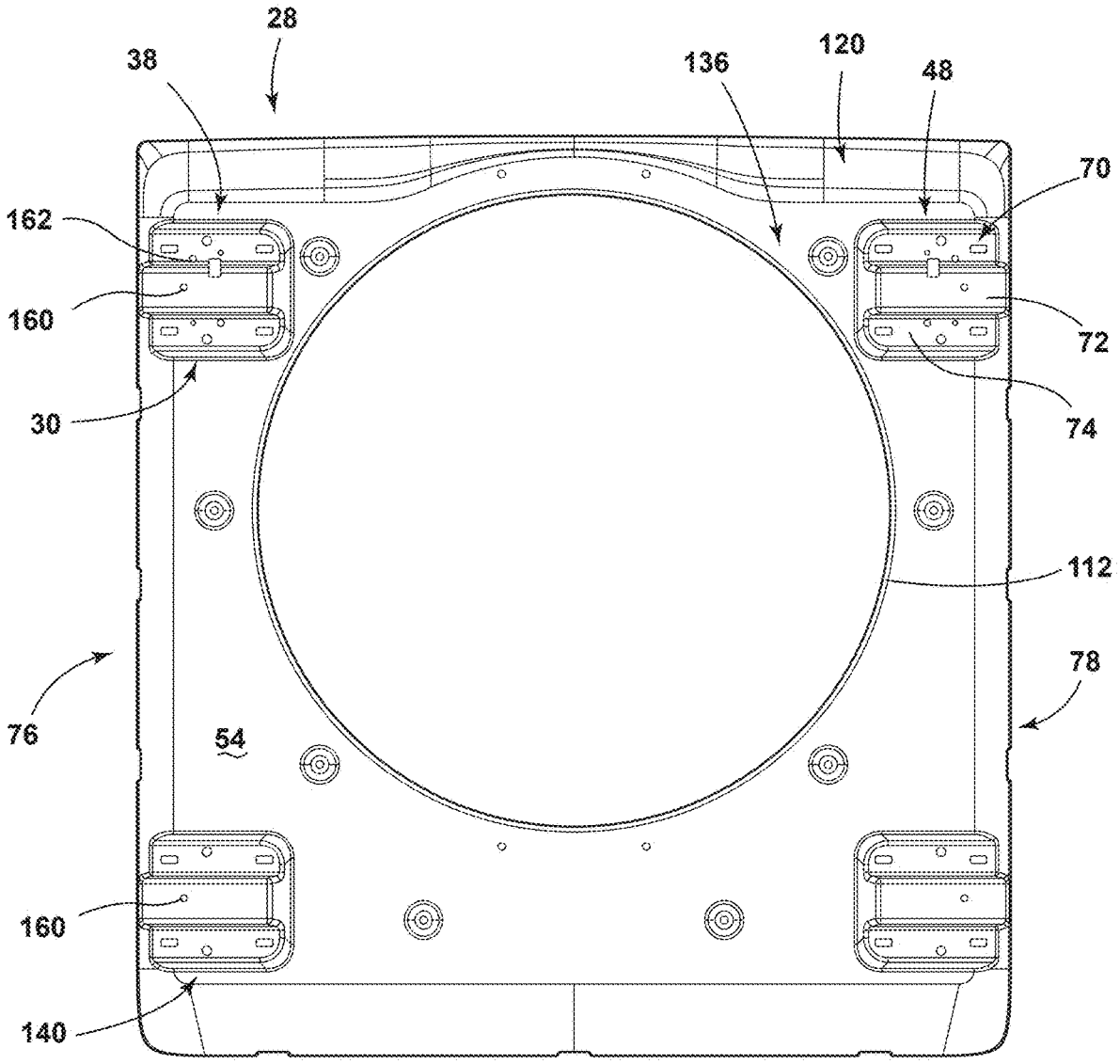
FIG. 2 is an elevation view of an aspect of the inner-facing panel.
Figure 3:
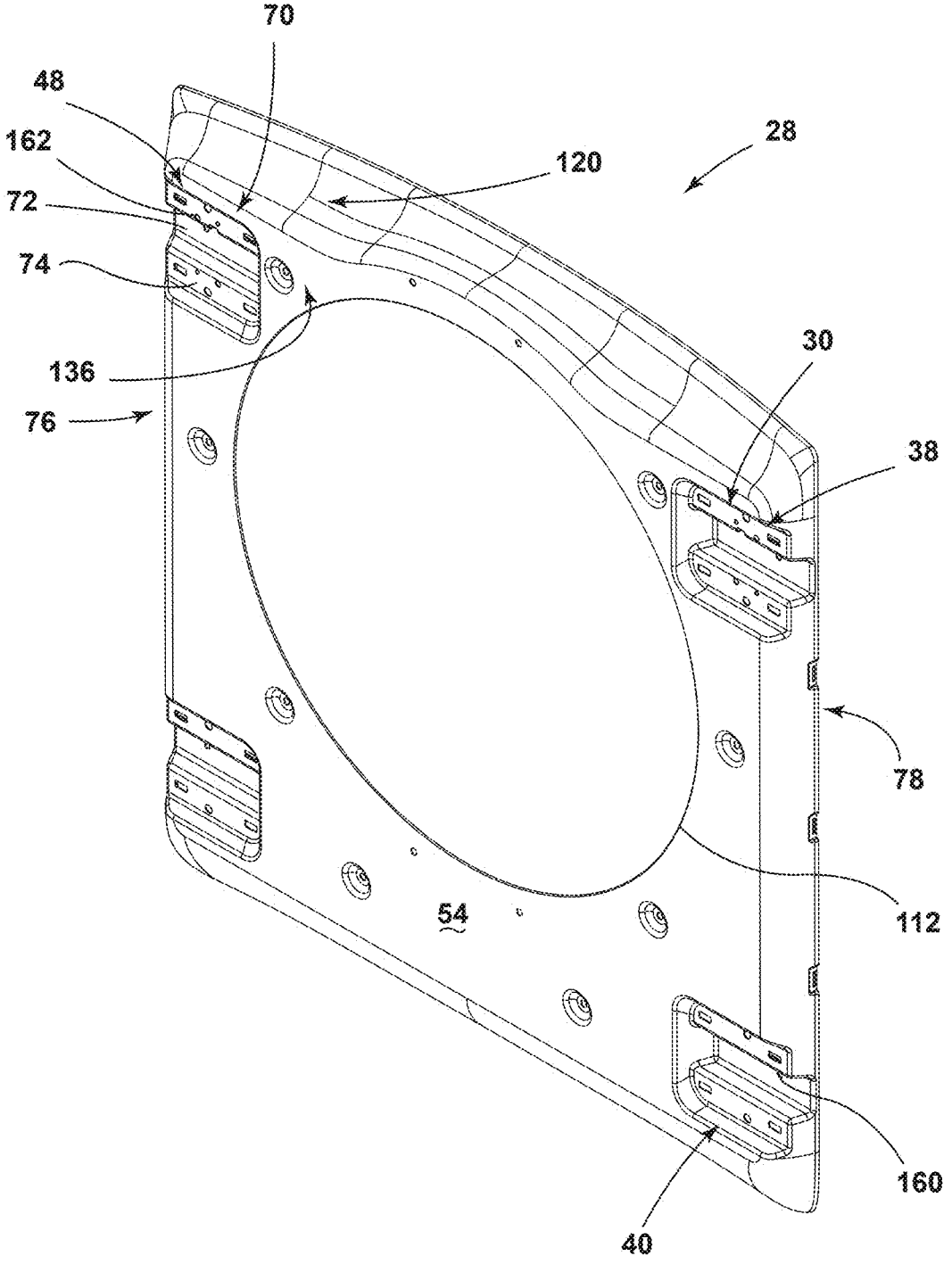
FIG. 3 is a perspective view of the inner-facing panel of FIG. 2 and illustrating an alternate door-swing configuration.
Figure 4:
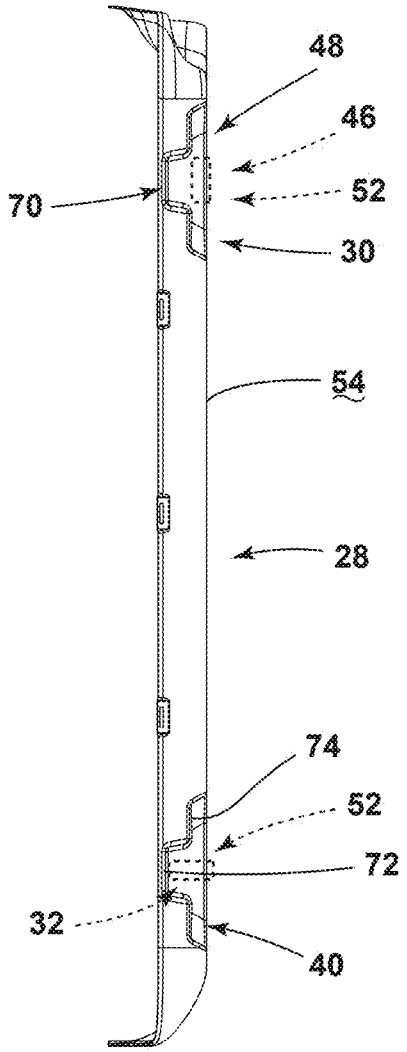
FIG. 4 is a side elevation view of the inner-facing panel of FIG. 2.
Figure 5:
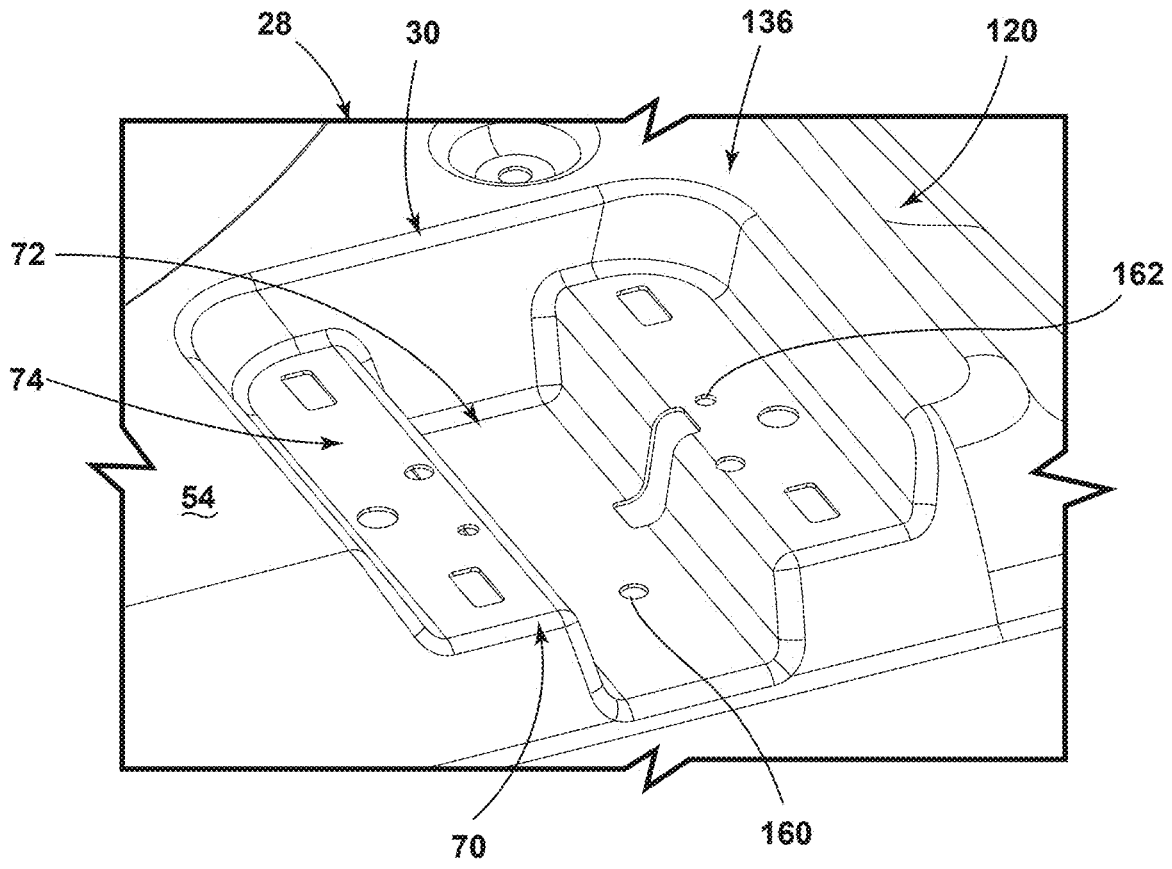
FIG. 5 is an enlarged perspective view of a recess for the inner-facing panel of FIG. 2.
Figure 6:
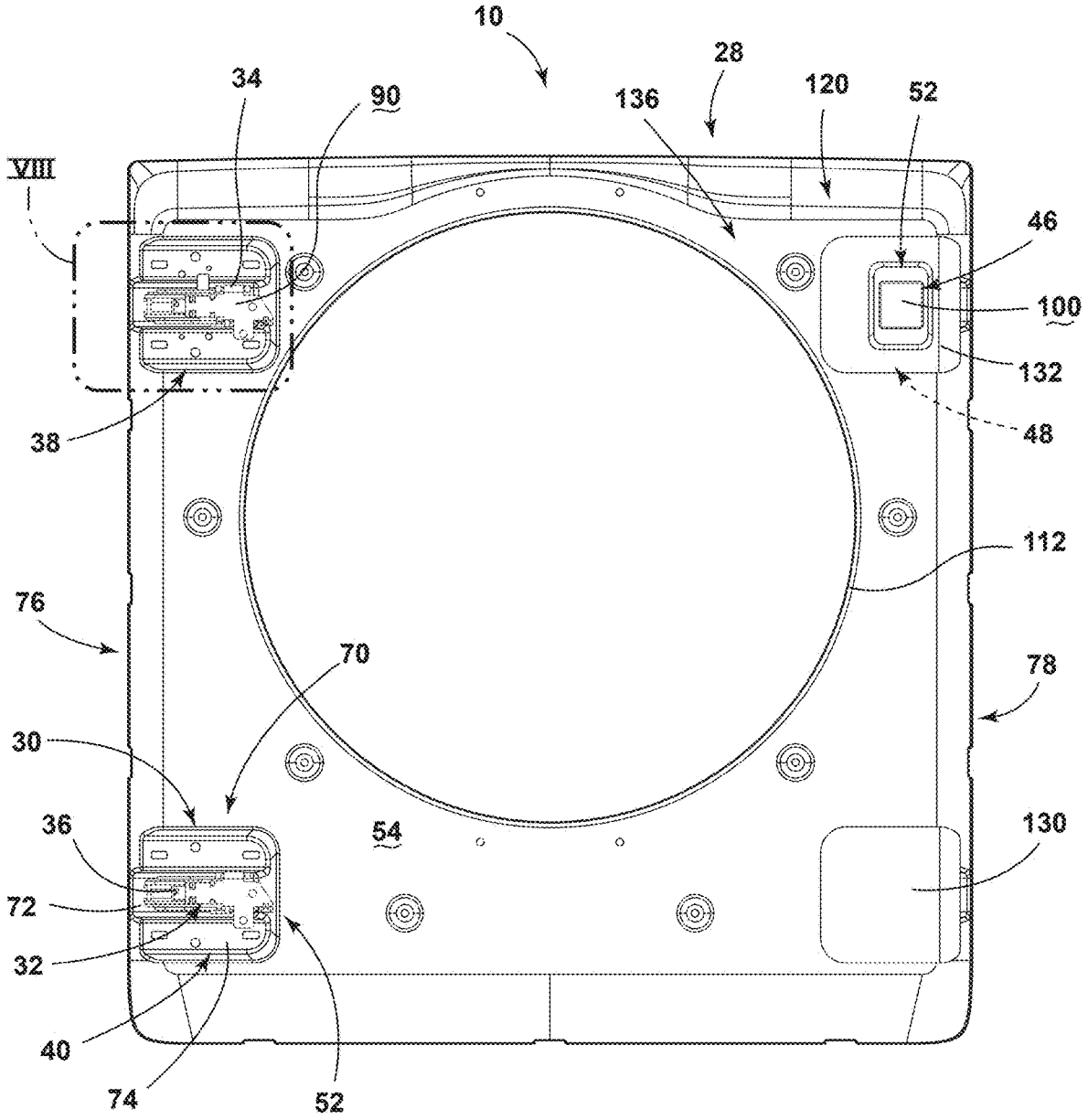
FIG. 6 is an elevation view of an aspect of the inner-facing panel and showing first and second hinges, a magnetic lock, and inserts attached to the recesses for the inner-facing panel.
Figure 7:
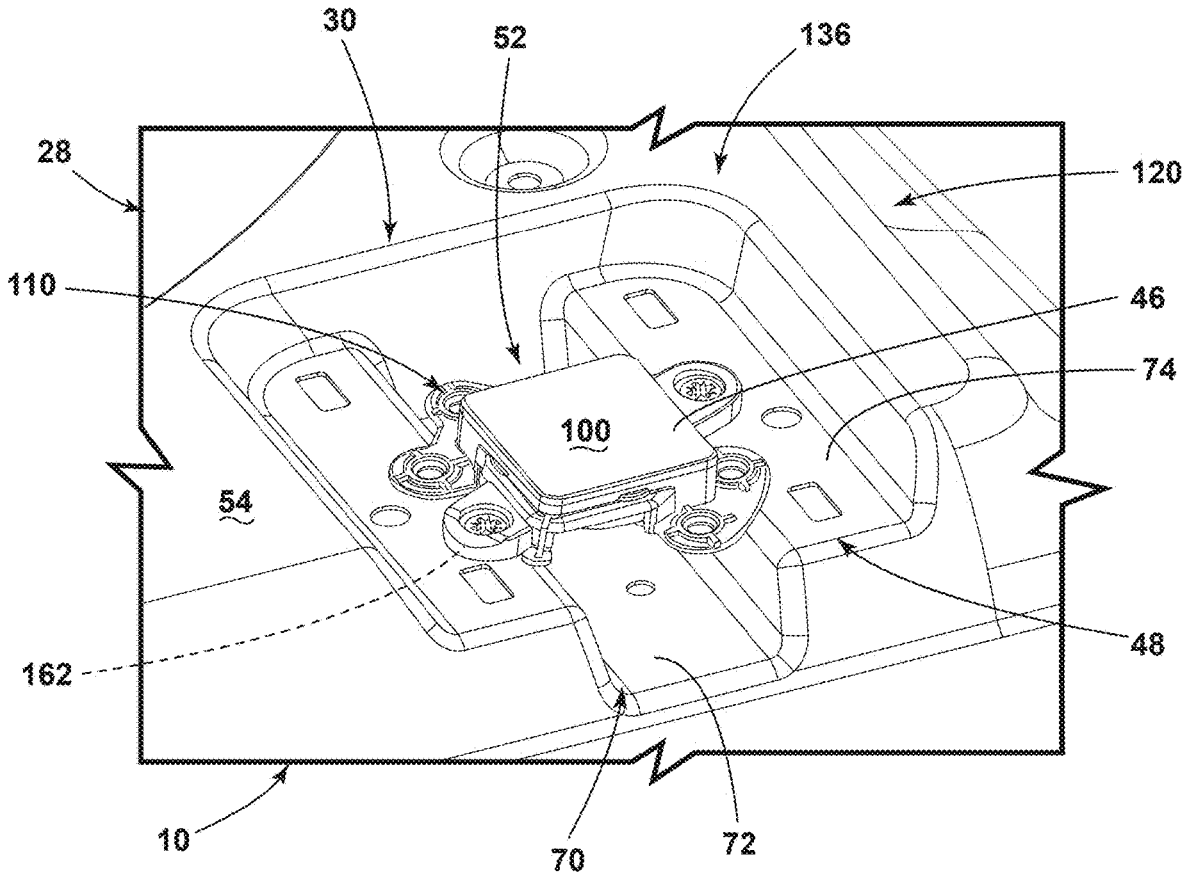
FIG. 7 is an enlarged perspective view of a recess of the inner-facing panel and showing engagement of the magnetic lock with the shallow step of the recess.
Figure 8:
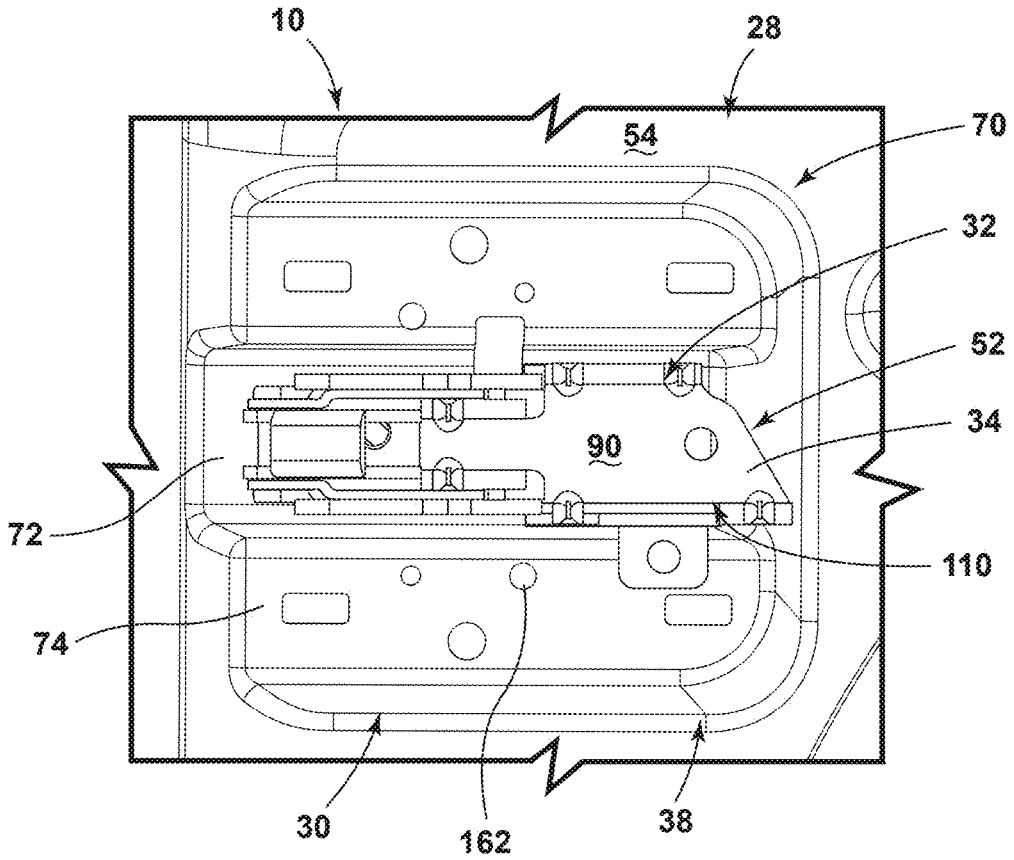
FIG. 8 is an enlarged elevation view of FIG. 6 taken at area VIII and showing the hinge disposed within the deep step of the recess.
Figure 9:
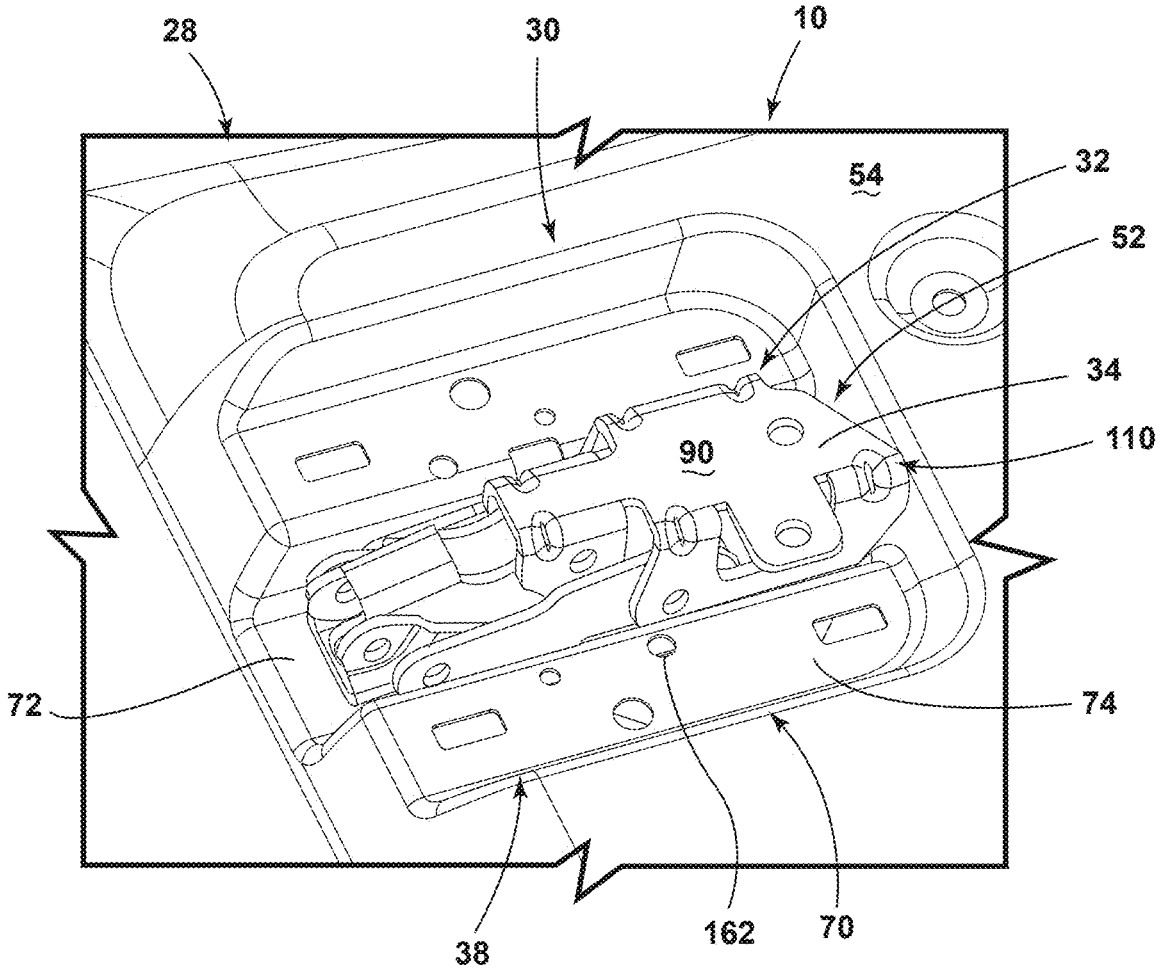
FIG. 9 is a perspective view of the hinge and recess of FIG. 8.
Figure 10:
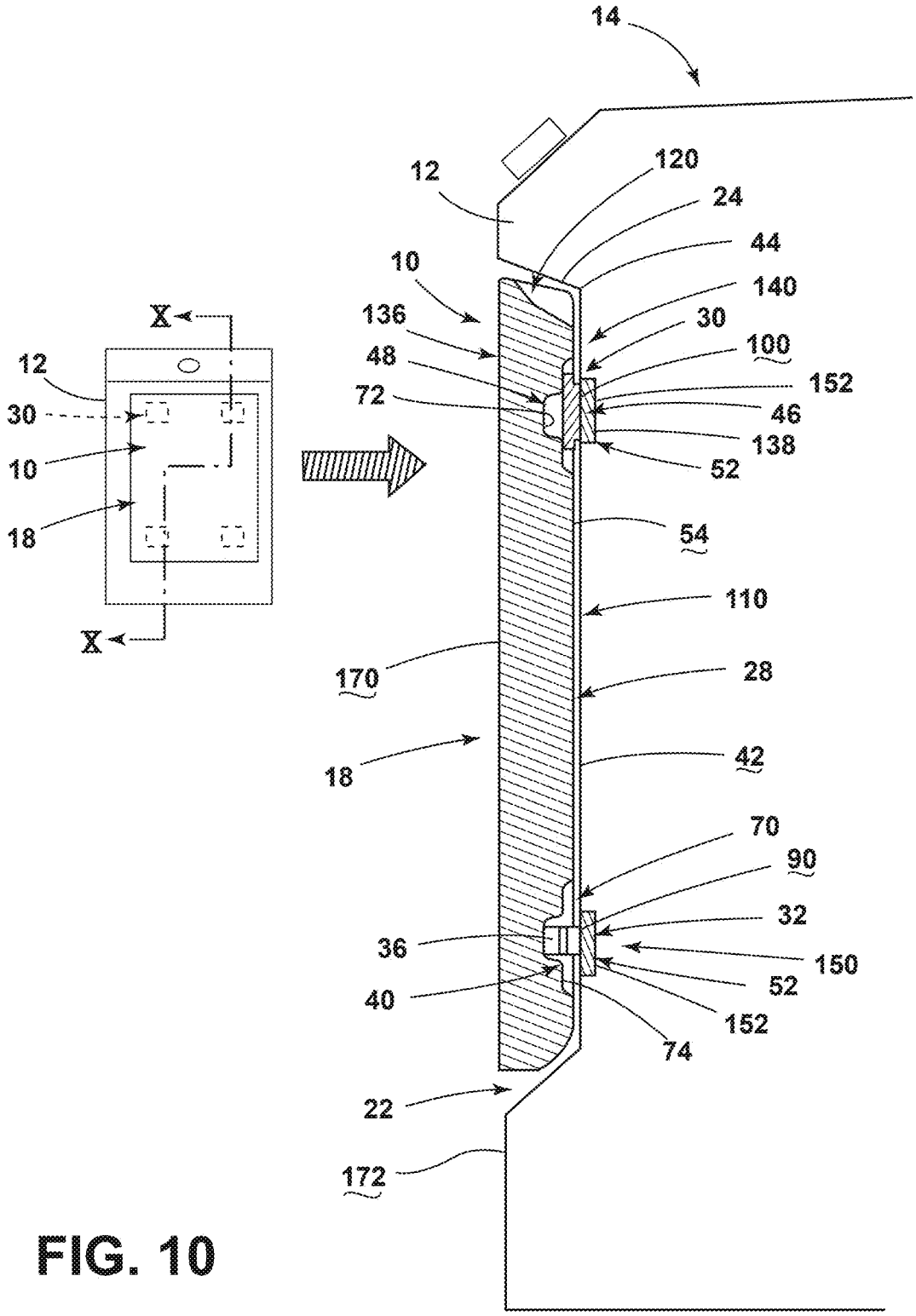
FIG. 10 is a schematic cross-sectional view of an appliance illustrating the flush configuration of the magnetic lock and the hinge of the door with respect to the outer surface of the inner-facing panel and with respect to a planar surface of the cabinet.

The components in the figures are not necessarily to scale, emphasis instead being placed upon illustrating the principles described herein.

DETAILED DESCRIPTION

The present illustrated embodiments reside primarily in combinations of method steps and apparatus components related to an inner-facing panel for the assembly of a door panel of an appliance that includes a plurality of recesses that each include a shallow step for receiving a magnetic lock and a deep step for receiving a hinge, where the shallow and deep steps position the magnetic lock and the hinges to be in a flush configuration with an outer surface of the inner-facing panel. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-10, reference numeral 10 generally designates a door panel that is attached to a cabinet 12 for an appliance 14, where the door panel 10 is rotationally operable between an open position 16 and a closed position 18. Typically, the door panel 10 is utilized for a cleaning appliance such as a washing appliance, drying appliance, combination washing and drying appliance, dishwashing appliance, and other similar appliances that utilize a fluid for cleaning certain articles.

Referring again to FIGS. 1-10, an appliance 14 includes an outer cabinet 12 having an access aperture 20 that is positioned within a door-receiving recess 22 of the cabinet 12. The access aperture 20 extends through a front panel 24 of the cabinet 12 and provides access to a processing space 26 that is defined within the cabinet 12, typically in the form of a tub and/or a rotating drum that is positioned within the cabinet 12. The door panel 10 is rotationally operable relative to the door-receiving recess 22 to selectively enclose the processing space 26 in a closed position 18 of the door panel 10. The door includes an inner-facing panel 28 that defines a plurality of recesses 30. Hinges 32, typically in the form of first and second hinges 34, 36, are fixedly attached to a first recess 38, and a second recess 40, respectively, of the plurality of recesses 30 of the inner-facing panel 28. The first and second hinges 34, 36 are also attached to a planar surface 42 of the cabinet 12 that is defined within the door-receiving recess 22. The planar surface 42 is oriented to surround the access aperture 20 and extend outward to a boundary 44 of the door-receiving recess 22. In this manner, the planar surface 42 can define a continuous or substantially continuous planar surface 42 that extends between the access aperture 20 and the boundary 44 of the door-receiving recess 22. A magnetic lock 46 is fixedly attached to a third recess 48 of the plurality of recesses 30. The magnetic lock 46 is selectively and magnetically attached to the planar surface 42 to define the closed position 18 of the door panel 10.

Referring again to FIGS. 1-10, the plurality of recesses 30 of the inner-facing panel 28 are each configured to selectively and alternatively receive one of the first hinge 34, the second hinge 36, and the magnetic lock 46 to define a swing direction 50 of the door panel 10 relative to the cabinet 12 and the access aperture 20. The hinges 32 are attached directly to the planar surface 42 and the magnetic lock 46 selectively engages the planar surface 42 in the closed position 18 of the door panel 10. When attached, the recesses 30, the first hinge 34, the second hinge 36, and the magnetic lock 46 are disposed in a flush configuration 52 with respect to the outer surface 54 of the inner-facing panel 28. This flush configuration 52 is described more fully herein. As discussed herein, the identity of the first recess 38, the second recess 40, and the third recess 48, among the plurality of recesses 30 can vary depending on the desired configuration of the appliance 14 and the door panel 10.

Referring again to FIGS. 1-10, each recess 30 of the plurality of recesses 30 for the inner-facing panel 28 includes a stepped configuration 70. This stepped configuration 70 includes a deep step 72 and a shallow step 74. The deep step 72 is configured to receive the first hinge 34 or the second hinge 36 to define the swing direction 50. Typically, the first and second hinges 34, 36 will be positioned within a pair of recesses 30 that are vertically oriented either on the left side 76 or the right side 78 of the inner-facing panel 28. This positioning of the first and second hinges 34, 36 dictates whether the door panel 10 will be open according to a right-hand swing or a left-hand swing.

In certain aspects of the device, it is contemplated that hinges 32 can also be positioned along horizontally aligned lower recesses of the inner-facing panel 28. In such a configuration, these hinges 32 can define a vertical-opening configuration of the door panel 10 where the door panel 10 rotates about a horizontal rotational access that extends through the lower recesses of the plurality of recesses 30.

Referring now to FIGS. 6-10, the deep step 72 of each recess 30 is configured to position a cabinet-attaching surface 90 of each of the first and second hinges 34, 36 to be flush with the outer surface 54 of the inner-facing panel 28. The cabinet-attaching surface 90 of each of the first and second hinges 34, 36 attaches to the planar surface 42 of the cabinet 12 defined within the door-receiving recess 22. In this manner, with the door panel 10 in the closed position 18, the first and second hinges 34, 36 extend from the planar surface 42 of the cabinet 12 and into the deep step 72 of the respective first and second recesses 38, 40. In turn, the cabinet-attaching surfaces 90 of the first and second hinges 34, 36 are placed in the flush configuration 52 with respect to the outer surface 54 of the inner-facing panel 28 and the planar surface 42 of the cabinet 12.

Through this configuration, the hinges 32 can be attached to each of the planar surface 42 of the cabinet 12 and the inner-facing panel 28 of the door panel 10. Simultaneously, the hinges 32 are recessed only within the deep step 72 of the inner-facing panel 28. Through this configuration, the planar surface 42 of the cabinet 12 can be maintained as a continuous or substantially continuous planar surface 42 that is free of, or substantially free of, additional or supplemental recesses that are defined within the planar surface 42. By minimizing or eliminating the use of additional recesses within the planar surface 42, this configuration minimizes the accumulation of fluid and material within these supplemental recesses, thereby making the surface of the cabinet 12 easier to clean and maintain.

The shallow steps 74 of the recesses 30 are configured to receive the magnetic lock 46. This configuration places a cabinet-engaging surface 100 of the magnetic lock 46 to be flush with the outer surface 54 of the inner-facing panel 28 and also flush with the cabinet-attaching surface 90 of each of the first and second hinges 34, 36. Accordingly, the cabinet-engaging surface 100 of the magnetic lock 46 and the cabinet-attaching surface 90 of the first and second hinges 34, 36 define a co-planar arrangement that is parallel with the planar surface 42 of the cabinet 12, and typically planar with the outer surface 54 of the inner-facing panel 28.

Throughout the specification, the terms "flush" and "flush configuration" are used with respect to the cabinet-attaching surfaces 90 of the first and second hinges 34, 36 and the cabinet-engaging surface 100 of the magnetic lock 46. The flush configuration 52 of these surfaces should be understood as being co-planar or substantially flush with the outer surface 54 of the inner-facing panel 28. It should also be understood that the terms "flush" and "flush configuration" should include configurations of these surfaces being minimally offset 110 from the outer surface 54 of the inner-facing panel 28. This offset 110 can be in the range of approximately 0.5 millimeters to approximately 1 millimeter. This offset 110 can also be in the range of approximately 1 millimeter to approximately 5 millimeters. This offset 110 can also be in the range of approximately 1 millimeter to approximately 10 millimeters. Each of these ranges of the offset 110 with respect to the outer surface 54 of the inner-facing panel 28 and the cabinet-attaching surfaces 90 of the first and second hinges 34, 36 and the cabinet-engaging surface 100 of the magnetic lock 46 should be viewed as being indicative of a flush configuration 52 with respect to one another.

According to various aspects of the device, any gap or offset 110 that may exist between the outer surface 54 of the inner-facing panel 28 and the planar surface 42 can be occupied by a seal, gasket, or other similar sealing interface 112 that extends between the door panel 10 and the cabinet 12 to prevent leakage of fluid from the processing space 26 to areas outside of the cabinet 12.

Referring again to FIGS. 1-10, when the door panel 10 is in the closed position 18, the offset 110 of the cabinet-attaching surfaces 90 of the first and second hinges 34, 36 and the cabinet-engaging surface 100 of the magnetic lock 46 also serves to place the outer surface 54 of the inner-facing panel 28 in a flush configuration 52 with respect to the planar surface 42 of the cabinet 12. As described herein, this offset 110 of these features should be considered to be in a flush configuration 52 with one another.

Referring again to FIGS. 1-10, it is contemplated that the inner-facing panel 28 can be in the form of a single stamped member. In such a configuration, a metal plate or panel can be stamped to define certain undulations and features that form the plurality of recesses 30, various handles 120 that are defined with the door panel 10, grooves or channels for receiving a sealing interface 112 that engages the cabinet 12, and other similar raised and recessed features within the inner-facing panel 28.

Referring again to FIGS. 1 and 6, various inserts 130 can be attached to the inner-facing panel 28 at one or more of the recesses 30. As described herein, the inner-facing panel 28 includes four recesses 30. The first and second recesses 38, 40 receive the first and second hinges 34, 36, respectively. As described herein, these first and second recesses 38, 40 are typically oriented along a left side 76 or a right side 78 of the inner-facing panel 28. The magnetic lock 46 is positioned within a third recess 48 that is located opposite the first and second recesses 38, 40. The fourth recess is typically left unused and can be covered using an insert 130 that conceals at least a portion of the fourth recess. The insert 130 can be a cosmetic panel or a spacer that can be used to prevent the infiltration or deposition of fluid and debris within the recess 30. Additionally, the recess 30 that includes the magnetic lock 46 can include a separate second insert 132 that is disposed within the third recess 48 and extends around the cabinet-engaging surface 100 of the magnetic lock 46. Typically, the cabinet-engaging surface 100 of the magnetic lock 46 is visible through the second insert 132 to allow for consistent magnetic engagement between the magnetic lock 46 and the planar surface 42 of the cabinet 12.

Using the magnetic lock 46, the planar surface 42, which is typically made of metal, can receive the magnetic lock 46 through the magnetic engagement of the cabinet-engaging surface 100. To provide a generally ferrous material, the front panel 24 of the cabinet 12 can be made of a ferrous metal. In addition, a ferrous panel 138 can be positioned behind the front panel 24 of the cabinet 12 that can provide a magnetic interface 140 for allowing the magnetic lock 46 to engage and selectively secure against for maintaining the door panel 10 in the closed position 18. As described herein, through this configuration, no additional or supplemental recesses are needed within the planar surface 42 for defining the magnetic engagement between the magnetic lock 46 on the door panel 10 and the planar surface 42 of the cabinet 12.

Referring again to FIGS. 1-10, as described herein, each recess 30 includes a stepped configuration 70 that includes a deep step 72 and a shallow step 74. The configuration of the deep step 72 with respect to the shallow step 74 can vary. As illustrated, the deep step 72 bisects the shallow step 74 such that the shallow step 74 is divided into opposing sections. When the magnetic lock 46 is attached to the shallow step 74, portions of the magnetic lock 46 can be attached to each of the bisected portions of the shallow step 74 and extend or span the deep step 72. Through this configuration, whether the first and second hinges 34, 36 or the magnetic lock 46 are attached to the respective recess 30, the location that the cabinet-attaching surface 90 of one of the first and second hinges 34, 36 or the cabinet-engaging surface 100 of the magnetic lock 46 engages the planar surface 42 will be a consistent and predictable engagement location 150 within the planar surface 42. Using this configuration, a structural member 152, which can also be the ferrous panel 138, can be positioned behind the front panel 24 within this engagement location 150 that receives one of the cabinet-engaging surface 100 and the cabinet-attaching surface 90. This structural member 152 can be made of a ferrous-type material or can include a ferrous insert that can be used to magnetically attach the magnetic lock 46 to the planar surface 42 via the structural member 152. Additionally, the structural member 152 can include various attachment features that can be used to secure fasteners that attach the cabinet-attaching surface 90 of each of the first and second hinges 34, 36 to the planar surface 42 using the structural member 152. Again, this engagement location 150 defined by the structural member 152 is a common location that each of the hinges 32 or the magnetic lock 46 will engage relative to the planar surface 42 when the door panel 10 is in the closed position 18.

According to various aspects of the device, the configuration of the deep step 72 and the shallow step 74 can change depending upon the configuration of the inner-facing panel 28. By way of example, and not limitation, the deep step 72 can be positioned adjacent to the shallow step 74 such that the shallow step 74 is next to the deep step 72. Additionally, it is contemplated that the deep step 72 can be contained within the shallow step 74 such that portions of the shallow step 74 surround or substantially surround the deep step 72 of the recess 30. In each of these configurations, the shallow step 74 is used to attach the magnetic lock 46 and the deep lock is used to attach the first and second hinges 34, 36 to the inner-facing panel 28.

Referring again to FIGS. 2-10, the deep step 72 of each recess 30 includes hinge fastening apertures 160 that are configured to attach the first and second hinges 34, 36 to the inner-facing panel 28. Additionally, the shallow step 74 of at least the two recesses 30 within an upper portion 136 of the inner-facing panel 28 include lock-fastening apertures 162 that are configured to attach the magnetic lock 46 to the inner-facing panel 28. As discussed herein, these lock-fastening apertures 162 are located on opposing portions of the shallow step 74 that are bisected by the deep step 72 within each recess 30.

As described herein, supplemental recesses are not needed within the planar surface 42 of the cabinet 12. Where the first and second hinges 34, 36 are attached to the planar surface 42 of the cabinet 12, certain indicia can be utilized within the engagement locations 150 planar surface 42 to define where certain fasteners should be engaged for attaching the first and second hinges 34, 36 to the planar surface 42. It is contemplated that in these selected engagement locations 150, certain weakened areas, pre-drilled holes, or other indicia can be utilized for defining where fasteners should be secured for attaching the first and second hinges 34, 36 to the engagement locations 150 of the planar surface 42. Additionally, the planar surface 42 can include thinned sections of the planar surface 42 that can be identified as the locations where fasteners are to be inserted to secure the hinge 32 to the planar surface 42. Where fastening openings may be present, caps or plugs can be used to fill these openings and to conceal such openings when not in use. In each of these configurations, the cabinet-attaching surface 90 of the first and second hinges 34, 36 engage the continuous, or substantially continuous planar surface 42 of the cabinet 12 that is defined within the door-receiving recess 22.

When the door panel 10 is within the door-receiving recess 22, an exterior surface 170 of the door panel 10 is configured to be flush or substantially flush with the external surface 172 of the cabinet 12 that surrounds the door-receiving recess 22. As described herein, this configuration of the cabinet 12 and the door panel 10 in the closed position 18 is achievable through the use of the hinges 32 and magnetic lock 46 that are recessed within the plurality of recesses 30 of the inner-facing panel 28 and not recessed with respect to the planar surface 42 of the cabinet 12. In addition, this configuration provides a thinned-profile configuration between the door panel 10 and the cabinet 12 while also achieving a smooth-configuration of the planar surface 42 within the door-receiving recess 22. Also, by minimizing apertures that are defined within the planar surface 42, the structural integrity of the planar surface 42 can be maintained to a higher degree.

The invention disclosed herein is further summarized in the following paragraphs and is further characterized by combinations of any and all of the various aspects described therein.

According to one aspect of the present disclosure, a laundry appliance includes an outer cabinet that has an access aperture positioned within a door-receiving recess of the cabinet. The access aperture provides access to a processing space within the cabinet. A door panel is rotationally operable relative to the door-receiving recess to selectively enclose the processing space in a closed position of the door panel. The door panel has an inner-facing panel that defines a plurality of recesses. Hinges are fixedly attached to first and second recesses, respectively, of the plurality of recesses, and to a planar surface of the cabinet within the door-receiving recess. The planar surface surrounds the access aperture. A magnetic lock is fixedly attached to a third recess of the plurality of recesses. The magnetic lock is selectively and magnetically attached to the planar surface to define the closed position. The plurality of recesses of the inner-facing panel are configured to selectively and alternatively receive one of the hinges and the magnetic lock to define a swing direction of the door panel. The hinges are attached directly to the planar surface and the magnetic lock selectively engages the planar surface in the closed position of the door panel.

According to another aspect, each recess of the plurality of recesses includes a stepped configuration that includes a deep step and a shallow step. The deep step is configured to receive one of the hinges to define the swing direction.

According to another aspect, the deep step of each recess is configured to position a cabinet-attaching surface of each of the hinges to be flush with an outer surface of the inner-facing panel, and the cabinet-attaching surface of the hinges attach to the planar surface.

According to another aspect, the planar surface is a continuous planar surface that extends within the door-receiving recess and around the access aperture.

According to another aspect, the door panel in the closed position is characterized by the hinges extending from the planar surface of the cabinet and into the deep step of the recess in the closed position is defined by the hinges being recessed only within the first and second recesses, respectively.

According to another aspect, the shallow step is configured to receive the magnetic lock and places a cabinet-engaging surface of the magnetic lock to be flush with the outer surface of the inner-facing panel.

According to another aspect, the closed position of the door panel is further characterized by an exterior surface of the door panel that is flush with an external surface of the cabinet that surrounds the door-receiving recess.

According to another aspect, the swing direction of the door panel can include one of a right-hand swing and a left-hand swing.

According to another aspect, the inner-facing panel is a stamped member that is attached to a back side of the door panel.

According to another aspect, the laundry appliance further includes a first insert that is received within a fourth recess of the plurality of recesses, and a second insert that is disposed within the third recess and extends around a cabinet-engaging surface of the magnetic lock.

According to another aspect of the present disclosure, a door panel for a laundry appliance includes an outer-facing panel. An inner-facing panel is attached to the outer-facing panel, and has a plurality of recesses. A pair of hinges are attached to first and second recesses of the plurality of recesses. Each hinge of the pair of hinges has a respective cabinet-attaching surface. A magnetic lock is attached to a third recess of the plurality of recesses. The magnetic lock has a cabinet-engaging surface. Each recess of the plurality of recesses includes a deep step that is configured to selectively and alternatively receive the magnetic lock and one hinge of the pair of hinges. The deep step is configured to receive one hinge of the pair of hinges and locate the respective cabinet-attaching surface to be flush with an outer surface of the inner-facing panel when the pair of hinges are in a closed position. A shallow step is configured to receive the magnetic lock and locate the cabinet-engaging surface to be flush with the outer surface of the inner-facing panel.

According to another aspect, the pair of hinges include the respective cabinet-attaching surfaces. The respective cabinet-attaching surfaces of the pair of hinges in the closed position and the cabinet-engaging surface of the magnetic lock define a plane that is flush with the outer surface of the inner-facing panel.

According to another aspect, the respective cabinet-attaching surfaces and the cabinet-engaging surface are configured to engage a continuous recessed planar surface of a cabinet for an appliance.

According to another aspect, the door panel in the closed position is characterized by the pair of hinges extending from the continuous recessed planar surface of a cabinet and into the deep step of the first and second recesses, respectively. The closed position is defined by the pair of hinges being recessed only within the first and second recesses, respectively.

According to another aspect, the deep step of each recess bisects the shallow step. The magnetic lock attaches to the shallow step and extends across the deep step.

According to another aspect, the third recess is disposed within an upper portion of the inner-facing panel.

According to another aspect, the deep step of each recess of the plurality of recesses includes hinge fastening apertures configured to attach the hinges to the inner-facing panel. The shallow step of each recess of the plurality of recesses includes lock-fastening apertures configured to attach the magnetic lock to the inner-facing panel.

According to another aspect, a door panel for an appliance further includes a first insert that is received within a fourth recess of the plurality of recesses, and a second insert that is disposed within the third recess and extends around the cabinet-engaging surface of the magnetic lock.

According to yet another aspect of the present disclosure, a door panel for a laundry appliance includes an inner-facing panel that is configured to selectively engage a continuous planar surface of a structural cabinet. The inner-facing panel has a plurality of recesses. Each recess of the plurality of recesses includes a shallow step and a deep step. First and second hinges are attached to respective first and second recesses of the plurality of recesses and within the deep step of the first and second recesses. The first and second hinges have a cabinet-attaching surface that is flush with an outer surface of the inner-facing panel. A magnetic lock is attached to a third recess of the plurality of recesses. The magnetic lock is attached to the shallow step and has a cabinet-engaging surface that is flush with the cabinet-attaching surface of each of the first and second hinges. Each recess of the plurality of recesses is configured to selectively and alternatively receive one of the magnetic lock, the first hinge, and the second hinge.

According to another aspect, the deep step extends through the shallow step to define bisected portions of the shallow step.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A door panel for a laundry appliance, the door panel comprising:

an outer-facing panel;

an inner-facing panel that is attached to the outer-facing panel, the inner-facing panel having a plurality of recesses;

a pair of hinges that are attached to first and second recesses of the plurality of recesses, each hinge of the pair of hinges having a respective cabinet-attaching surface; and a magnetic lock that is attached to a third recess of the plurality of recesses, the magnetic lock having a cabinet-engaging surface; wherein each recess of the plurality of recesses includes a deep step that is configured to selectively and alternatively receive the magnetic lock and one hinge of the pair of hinges;

the deep step is configured to receive one hinge of the pair of hinges and locate the respective cabinet-attaching surface to be flush with an outer surface of the inner-facing panel when the pair of hinges are in a closed position; and a shallow step is configured to receive the magnetic lock and locate the cabinet-engaging surface to be flush with the outer surface of the inner-facing panel.

2. The door panel of claim 1, wherein the pair of hinges include the respective cabinet-attaching surfaces, and wherein the respective cabinet-attaching surfaces of the pair of hinges in the closed position and the cabinet-engaging surface of the magnetic lock define a plane that is flush with the outer surface of the inner-facing panel.

3. The door panel of claim 1, wherein the respective cabinet-attaching surfaces and the cabinet-engaging surface are configured to engage a continuous recessed planar surface of a structural cabinet.

4. The door panel of claim 3, wherein the door panel in the closed position is characterized by the pair of hinges extending from the continuous recessed planar surface of the structural cabinet and into the deep step of the first and second recesses, respectively, and wherein the closed position is defined by the pair of hinges being recessed only within the first and second recesses, respectively.

5. The door panel of claim 1, wherein the deep step of each recess of the plurality of recesses bisects the shallow step, wherein the magnetic lock attaches to the shallow step and extends across the deep step.

6. The door panel of claim 1, wherein the third recess is disposed within an upper portion of the inner-facing panel.

7. The door panel of claim 1, wherein the deep step of each recess of the plurality of recesses includes hinge fastening apertures that are configured to attach the pair of hinges to the inner-facing panel, and wherein the shallow step of each recess of the plurality of recesses includes lock-fastening apertures that are configured to attach the magnetic lock to the inner-facing panel.

8. The door panel of claim 1, further comprising:

a first insert that is received within a fourth recess of the plurality of recesses; and a second insert that is disposed within the third recess and extends around the cabinet-engaging surface of the magnetic lock.

9. A door panel for a laundry appliance, the door panel comprising:

an inner-facing panel that is configured to selectively engage a continuous planar surface of a structural cabinet, the inner-facing panel having a plurality of recesses, wherein each recess of the plurality of recesses includes a shallow step and a deep step;

first and second hinges that are attached to respective first and second recesses of the plurality of recesses and within the deep step of the first and second recesses, each of the first and second hinges having a respective cabinet-attaching surface that is flush with an outer surface of the inner-facing panel; and a magnetic lock that is attached to a third recess of the plurality of recesses, the magnetic lock being attached to the shallow step and having a cabinet-engaging surface that is flush with the cabinet-attaching surface of each of the first and second hinges, wherein each recess of the plurality of recesses is configured to selectively and alternatively receive one of the magnetic lock, the first hinge and the second hinge.

10. The door panel of claim 9, wherein the deep step extends through the shallow step to define bisected portions of the shallow step.

11. The door panel of claim 9, wherein the respective cabinet-attaching surfaces and the cabinet-engaging surface are configured to engage a continuous recessed planar surface of the structural cabinet.

12. The door panel of claim 11, wherein the door panel in a closed position is characterized by the first and second hinges extending from the continuous recessed planar surface of the structural cabinet and into the deep step of the first and second recesses, respectively, and wherein the closed position is defined by the first and second hinges being recessed only within the first and second recesses, respectively.

13. The door panel of claim 9, wherein the magnetic lock attaches to the shallow step and extends across the deep step.

14. The door panel of claim 9, wherein the third recess is disposed within an upper portion of the inner-facing panel.

15. The door panel of claim 9, wherein the deep step of each recess of the plurality of recesses includes hinge fastening apertures that are configured to attach the first and second hinges to the inner-facing panel, and wherein the shallow step of each recess of the plurality of recesses includes lock-fastening apertures that are configured to attach the magnetic lock to the inner-facing panel.

16. The door panel of claim 9, further comprising:

a first insert that is received within a fourth recess of the plurality of recesses; and a second insert that is disposed within the third recess and extends around the cabinet-engaging surface of the magnetic lock.

17. A door panel for an appliance, the door panel comprising:

an inner-facing panel that defines a plurality of recesses;

hinges that are fixedly attached to first and second recesses, respectively, of the plurality of recesses, the hinges configured to attach to a planar surface of a cabinet; and a magnetic lock that is fixedly attached to a third recess of the plurality of recesses, wherein, the plurality of recesses of the inner-facing panel are configured to selectively and alternatively receive one of the hinges and the magnetic lock to define a swing direction of the door panel;

each recess of the plurality of recesses includes a stepped configuration that includes a deep step and a shallow step, wherein the deep step extends through the shallow step to define bisected portions of the shallow step; and the deep step is configured to receive one of the hinges to define the swing direction.

18. The door panel of claim 17, wherein the deep step of each recess of the plurality of recesses is configured to position a cabinet-attaching surface of each of the hinges to be flush with an outer surface of the inner-facing panel, wherein the cabinet-attaching surface of each hinge is configured to attach to the cabinet, and wherein the shallow step is configured to receive the magnetic lock and places a cabinet-engaging surface of the magnetic lock to be flush with the outer surface of the inner-facing panel.

19. The door panel of claim 17, wherein the inner-facing panel is a stamped member that is attached to a back side of the door panel.

20. The door panel of claim 17, further comprising:

a first insert that is received within a fourth recess of the plurality of recesses; and a second insert that is disposed within the third recess and extends around a cabinet-engaging surface of the magnetic lock.

* * * * *